US005282508A

United States Patent [19]

Ellingsen et al.

[11] Patent Number: 5,282,508

[45] Date of Patent: Feb. 1, 1994

[54] PROCESS TO INCREASE PETROLEUM RECOVERY FROM PETROLEUM RESERVOIRS

[75] Inventors: Olav Ellingsen, Floro, Norway; Carlos Roberto Carvalho de Holleben, Rio de Janeiro, Brazil; Carlos Alberto de Castro Goncalves, Rio de Janeiro, Brazil; Euclides J. Bonet, Rio de Janeiro, Brazil; Paulo José Villani de Andrade, Rio de Janeiro, Brazil; Roberto F. Mezzomo, Rio de Janeiro, Brazil

[73] Assignees: Petroleo Brasilero S.A. - PETROBRAS, Rio de Janeiro, Brazil; Ellingsen and Associates A.S., Floro, Norway

[21] Appl. No.: 908,173

[22] Filed: Jul. 2, 1992

[30] Foreign Application Priority Data

Jul. 2, 1991 [BR] Brazil ..... PI 9102789

[51] Int. Cl.[5] ..... E21B 43/00

[52] U.S. Cl. ..... 166/249; 166/65.1

[58] Field of Search ..... 166/244.1, 249, 248, 166/250, 65.1, 66, 66.4

[56] References Cited

U.S. PATENT DOCUMENTS

| | | | |
|---|---|---|---|
| 3,527,300 | 9/1970 | Phillips | 166/249 |
| 4,345,650 | 8/1982 | Wesley | 166/65.1 X |
| 4,479,680 | 10/1984 | Wesley | 166/249 |
| 5,101,899 | 4/1992 | Hoskins et al. | 166/249 X |

*Primary Examiner*—Thuy M. Bui

*Attorney, Agent, or Firm*—Sughrue, Mion, Zinn Macpeak & Seas

[57] ABSTRACT

A process and apparatus are provided to enhance the recovery of petroleum from onshore and offshore reservoirs. The process includes the simultaneous stimulation of the formation by elastic sound waves, created by a sonic source installed at the oil well so that the elastic sonic waves which are superimposed reduce the adherence forces in the layer between oil/water and the rock formation, and by the oscillating electrical stimulation of the same layer, as from the same wells subject to sonic treatment. The electricity heats the formation by using resistive heating, and thus increases the pressure, thus eliminating the surface tensions between the faces of the fluid as a consequence of the oscillatory action of the ions in the surfaces of the fluid and in addition, reducing the viscosity of the fluids. The process is achieved as the petroleum is produced in the wells thus treated, and the flow of petroleum acts then as a cooling agent which removes the heat released by the well area and thus allows a larger input of energy than in any other method known so far.

13 Claims, 12 Drawing Sheets

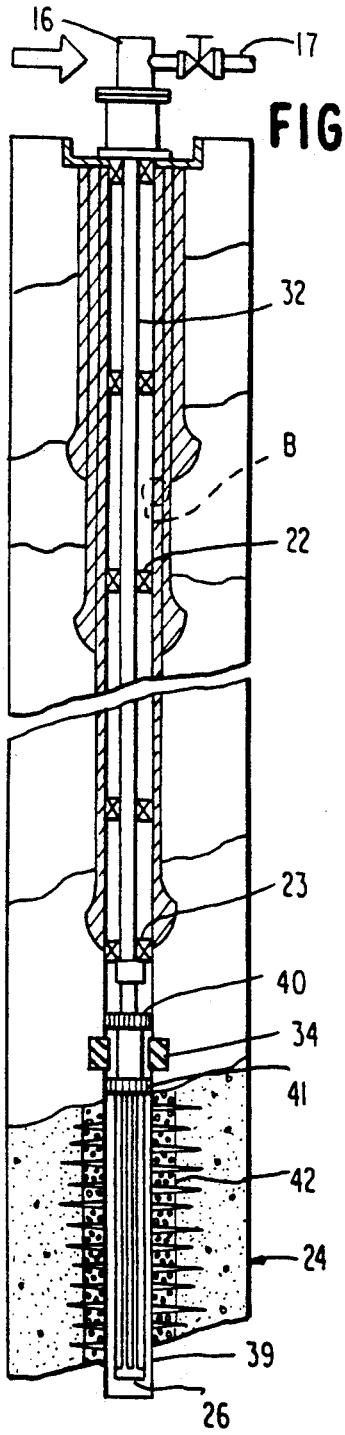
FIG.5A
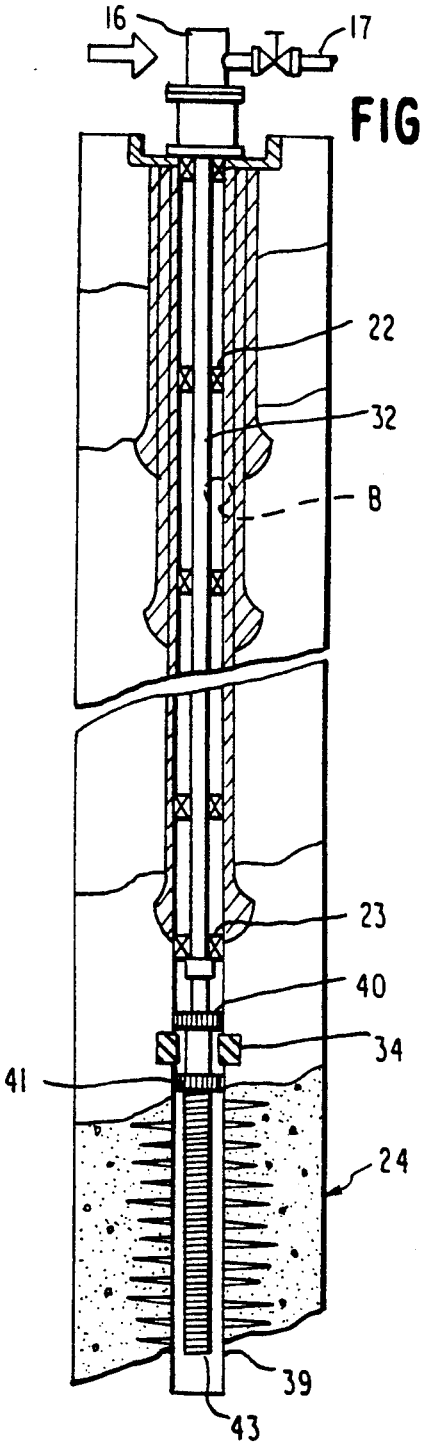
FIG.6A
FIG.5B
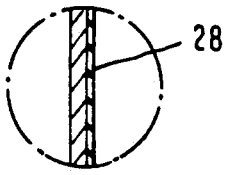
FIG.6B
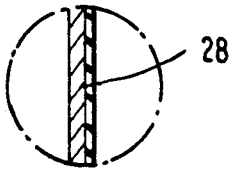

FIG. 7A
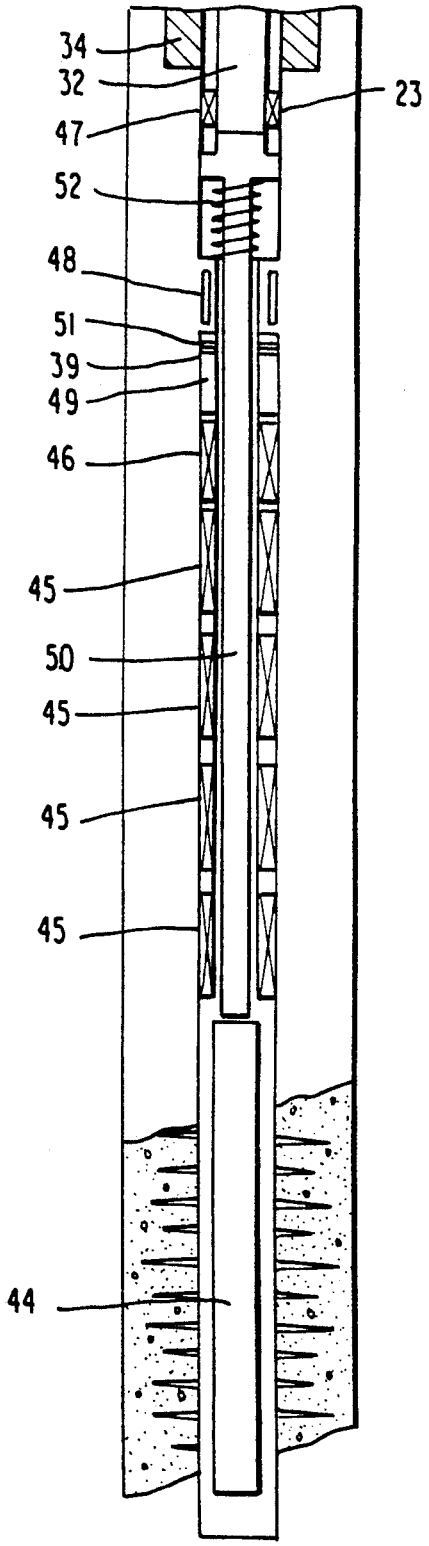
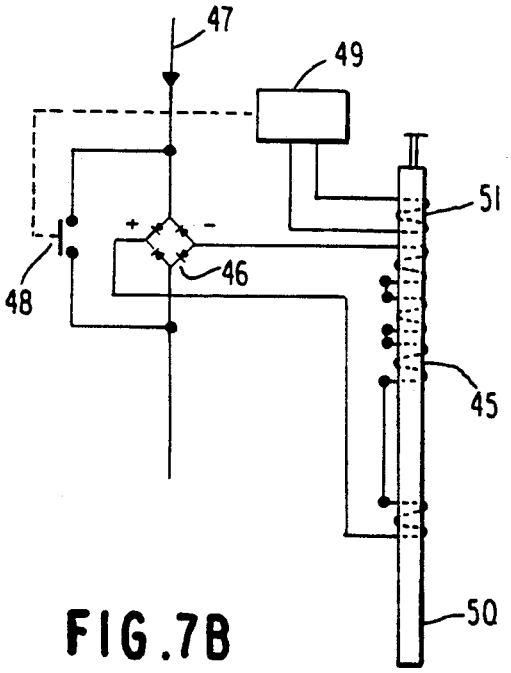
FIG. 7B

FIG. 9A
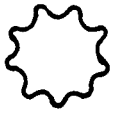
FIG. 9B
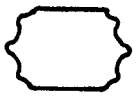
FIG. 9C
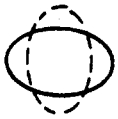
FIG. 9D
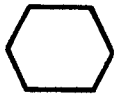
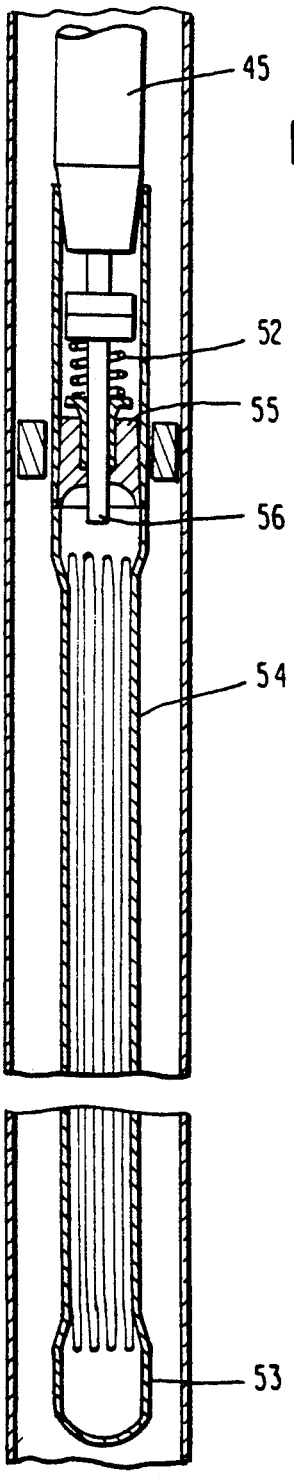
FIG. 9E
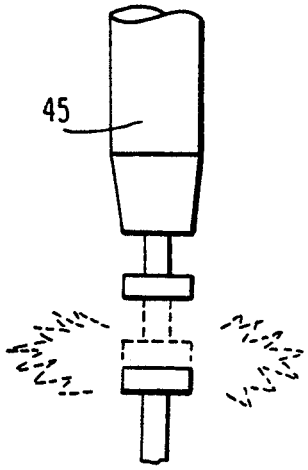
FIG. 9F

PROCESS TO INCREASE PETROLEUM RECOVERY FROM PETROLEUM RESERVOIRS

FIELD OF THE INVENTION

This invention refers to an improved method for petroleum recovery, by means of electrical and acoustic stimulation of formation layers, as from the same petroleum wells through which petroleum production is developed.

BACKGROUND OF THE INVENTION

Hydrocarbons known as crude oil are found in the world usually retained in sandstones of different porosities. The reservoirs lay from a few meters to several thousand meters below the earth surface and the seabottom, and vary largely in size and complexity, with respect to their fluid and gas contents, pressures and temperatures.

Petroleum is produced by means of wells drilled into the formations. The well itself is a complicated construction, including casings which protect the well bore against the formation itself and the pressures exerted by the reservoir fluids. Depending upon the depth, the casings are subjected to a stepwise reduction in diameter. In other words, pipe diameter decreases as depth increases. It is not unusual to have 50" (127 cm) casing in the upper regions and 7.5" (19,05 cm) casing in the lower ones.

Petroleum itself is drained from the productive formation by means of holes drilled in the casing, being, thereafter, lifted to the surface through which is referred to as production tubing. This tubing is centralized inside the casing by means of special centralizers, so that an annulus exists between the producting tubing and the casing.

Petroleum is initially produced due to the original reservoir pressure being higher than the complex forces of fluid adherence to the porous media. As pressure decreases in the course of production, a point of equilibrium is reached in which the adhesion forces are higher than the remaining pressure in place. At this point most part of the petroleum is still in the reservoir. It is estimated, in a global average, to be equal to nearly 85% of the petroleum which was there initially, but the recovery indexes vary largely from one reservoir to another. As an example we mention the Ekofish field, in the North Sea, where the primary recovery index was 17% of the original oil in place (OOIP), and the Statfjord, where said index is estimated in 45% of OOIP.

The object of all methods designed to improve petroleum recovery is, therefore, that of trying to overcome those adherences. The theoretical base to explain the cause of those adherences is as follows:

A—forces due to wettability
B—forces due to permeability
C—capillary forces
D—adhesive and cohesive forces It is convenient that the adherence forces dealt with in this invention be explained more in detail.

A—WETTABILITY

Wettability is one of the main parameters which affect the location, the flow and the distribution of reservoir fluids. The wettability of a reservoir affects its capillary pressure, its relative permeability, its behavior under water injection, its dispersion, and its electrical properties.

In an oil/water/rock system, wettability is a measure of the affinity which the rock exhibits to oil or to water. The wettability of reservoir rocks varies from strongly waterwet to strongly oilwet. In case the rock does not exhibit any strong affinity for either fluid its wettability is said to be neutral or intermediate. Some reservoirs exhibit a wettability which is heterogeneous or localized, existing crude oil components which are strongly adsorbed in certain areas. Thus, part of the rock becomes strongly oilwet, whereas the remainder may be strongly waterwet. In other reservoirs what is referred to as mixed wettability may be found, since oil remains localized in the largest pores, oilwet, in the form of continuous paths which pass by the rock, whereas water remains restricted to the smallest pores, waterwet.

Three methods are presently utilized to quantitatively measure the wettability: contact angle, Amott method and USBM method. Through the contact angle one measures the wettability of crude oil with brine in a polished mineral surface. The method serves to verify the effect of factors such temperature, pressure and chemicals on wettability.

It is believed that most minerals present in petroleum reservoirs, particularly silicates, are originally waterwet. The arenitic reservoirs were deposited in aqueous environments to which oil migrated later on. In the course of that process the wettability of reservoir minerals may be altered by the adsorption of polar compounds and/or deposits of organic matter originally present in crude petroleum. The polar extremities of those molecules may be adsorbed onto the rock surface, forming a thin organic film, which on its turn shall render the surface oilwet. Depending upon the temperature and pressure in the reservoir, those mechanisms may alter the degree of wettability. Little research has been conducted to investigate how a mechanical interference can affect the wettability. The wettability of an oil/water/rock system depends upon the adsorption and desorption of polar compounds (electrical dipoles) in crude petroleum on the mineral surface, which on its turn depends upon the type of solubility of those compounds in the reservoir fluid.

To approach the problem of wettability one must associate these electrical dipoles to the mechanical stimulation so that the wettability is not allowed to return to its original state.

B—PERMEABILITY

Permeability is the capacity of the porous rock to conduct fluids, that is, the property which characterizes the facility with which a fluid can flow through a porous medium when subject to the influence of the application of a pressure gradient. Permeability is defined by Darcy's law, being a macroscopic property of the porous medium. Permeability is evidently related to the geometry of the porous structure, its porosity, tortuosity, and distribution of pore size.

The concept of relative permeability is used in the situations in which two immiscible fluids, such as oil and water, flow simultaneously through a porous medium. Those permeability independ on the flow rate and of the fluid properties, and depend exclusively on the fluid saturations within the porous medium. The measurement of relative permeability is a critical factor in reservoir engineering, since it constitutes the predominant factor for the knowledge of flow properties in a petroleum reservoir.

Controlling or improving the permeability is, then, a factor most important to improve the sweeping efficiency in displacements with water. It must be said that the displacement with polymers is the method most utilized in mobility control. Water-soluble polymers are added to the water to be injected with the purpose of improving the mobility ratio, through the increase in viscosity and reduction of the permeability of the zones invaded, and, thus, preventing the water from breaking through prematurely.

A great deal of research has been conducted for the purpose of creating polymers sufficiently inexpensive for this object, but with little success so far.

C—CAPILLARY FORCES

The equilibrium saturation in a petroleum reservoir prior to initiating its production is controlled by rock geometry and by fluid characteristics. Since water and hydrocarbons are immiscible fluids, a pressure differential exists—the capillary pressure—between the two fluid phases. If a wet fluid is displacing a non-wet fluid, the critical capillary pressure—depending upon pore size—must be overcome by the pressure differential in order to displace the wet fluid phase from those pores.

The ratio between the pressure differential applied (equivalent to the capillary pressure) and the saturation characterizes the distribution of pore dimensions. The curve of critical capillary pressure verified for reservoir rocks serves to indicate the oil distribution in the reservoir and is, therefore, a major parameter to predict the oil saturation at different depths.

The capillary pressure is usually measured by the centrifugal method, through which a rock sample with original reservoir fluid saturations is immersed in the wetting fluid and centrifuged at a series of selected angular velocities. For each velocity the average sample saturation is determined, and this, on its turn, is then correlated to the corresponding capillary pressure, by means of rather laborious numerical calculations (Hassler-Brunner method).

Since the capillary pressure may oppose to oil recovery, particularly in the case of small pores, it is most important to be able to control or reduce the capillary critical point in the tertiary oil recovery.

Chemical methods based on tensoactives are usually employed, such as surfactants to reduce the interfacial tension. The results described in the literature, however, show that the utilization of tensoactives has produced limited results due to the high cost of those products and their large consumption by the reservoir rock.

D—ADHESIVE AND COHESIVE FORCES

The molecular forces which exist between two layers of different or similar substances are those which generate the adhesive or cohesive forces, respectively.

In the case of a fluid in porous rocks adhesive forces shall exist between the fluid and the pore walls. Such forces appear particularly in the oil phase, as a consequence of the polar components in the hydrocarbons.

The adhesive forces are probably weaker than the capillary forces mentioned above.

Since petroleum plays a preponderant role in world economy, huge efforts are being made to extend the production, in addition to the so-called primary recovery or natural reservoir depletion. Various methods are known, discussed in the literature on the subject, as well as in ancient and recent patent documents.

The oldest technique, and for such reason the most well-known, has been that of injecting water or gas in what is usually referred to as injection well, aiming at increasing the pressure and thus "squeezing" some more petroleum from the well. Other well-known techniques consist of different chemical and thermal methods, amongst which we mention the following examples extracted from the book, "Enhanced Oil Recovery, 1, Fundamentals and Analyses", by E. C. Donaldson, G. V. Chillingarian, and F. Yen, ELSEVIER 1985.

Chemical Injection (alkalis)—This method requires a pre-washing to prepare the reservoir, and the injection of an alkaline solution or an alkaline polymer solution, which generates surfactants in situ, to release the oil. Thereafter a polymer solution is applied, to control the mobility, and a driving fluid (water), to displace the chemicals and the oil bank resulting from the process of recovery towards the production wells.

Carbon Dioxide Injection—This method is a miscible-displacement process which is adequate to many reservoirs. The most feasible method is usually the utilization of a $CO_2$ bank, followed by alternating injections of water and $CO_2$ (WAG).

Steam Injection—The heat, from the steam injected in a heavy-oil reservoir, renders this oil less viscous, thus displacing oil more easily through the formation, towards the production wells.

Cyclic Steam Stimulation=In this process, which usually precedes the continuous steam injection, injection occurs in the producing wells at time intervals followed by well shutting-in, for heat dissipation and later return to production. These cycles are repeated until the production index becomes smaller than a minimum profitable level.

In-Situ Combustion—This process encompasses the ignition and controlled burning in situ of the formation oil, using the injection of pure oxygen or air as comburent. The heat released and the high-pressure gases make easy to displace the heavy oils towards the producing wells.

The textbook "Thermal Recovery", by Michael Prats, Monograph Volume 7, Henry L. Doherty Series 1986, deals with the technology involved in thermal recovery, the purpose of which is to heat the reservoir by different methods. The book mentions also other applications of reservoir heating, and teaches how to utilize the formation heating around the well area, by means of electricity. Electrical current is conducted by means of an isolated conduit, to a stainless steel screen at the bottom of the well area. The current then flows out of the screen, passes by the oil at the bottom of the well, through the casing, and returns to a grounded conduit at the surface. In addition to problems of electrical connections at the bottom of the well, when the current flows through the liquid, most of the energy is lost in the earth layers, even if its resistivity is lower than that of the reservoir. This occurs because the current has to follow a distance hundreds of times longer in the earth layer.

Since those systems manage to deal with only part of the adhesion forces, large efforts have been made to overcome the problem, improving thus the recovery by means of more elaborated methods.

For the present application and for the patents to which reference is made as follows, it is important to present a more detailed description of the adhesion forces.

DESCRIPTION OF THE PRIOR ART

In the patents presented as follows it has been tried to solve the above mentioned problem. Same are relevant to the present invention, since they can be seen as synthesis of the prior techniques.

U.S. Pat. No. 2,670,801 (J.E. SHERBORNE) deals with the use of sonic or supersonic waves to increase the recovery and production of crude oil in petroleum formations. More precisely, it deals with the utilization of sonic and ultrasonic vibrations, together with secondary recovery processes which utilize driving fluids, such as water injection, or gas injection, or similar ones, through which the efficiency of the driving fluid utilized for the extraction of the petroleum remaining at the formation is improved.

U.S. Pat. No. 2,799,641 (THOMAS GORDON BELL) refers to promoting the oil flow from a well by electrolytical means. It describes a method to stimulate the well area with electricity only, but utilizing direct current, since the purpose of the invention is to increase the recovery through the well-known phenomenon of electroosmosis.

U.S. Pat. No. 3,141,099 (C. W. BRANDON) presents a device installed at the well bottom and is used to heat part of the well area by means of dielectric or arc heating. The only heating which may be achieved with this invention is the resistance heating. It shall not be possible to heat by means of arc since this would require electrodes arranged rather close between each other, and then the arcs would melt the rocks reached by same. As it shall be seen later on, our invention is much different, since it utilizes a method to heat the reservoir, in situ, both electrically and with vibrations.

U.S. Pat. No. 3,169,577 (ERICH SARAPUU) refers to the means to connect subsoil electrodes, between each other, by means of electrical impulses, and relates precisely to methods oriented towards flowing induction in producing wells. The purpose is to drill additional wells, as well as to create fissures or fractures near the well bore to increase, thus, the drainage surface of the wells and heat the hydrocarbons close to the well with the purposes of reducing the viscosity of such hydrocarbons.

U.S. Pat. No. 3,378,075 (BODINE) refers to a sonic vibrator to be installed inside the well to subject it to high-level sonic energy only, so as to achieve sonic pumping in the well area. As a consequence of said high-level sonic energy (and without the utilization of such device associated to electrical stimulation), the effect of muffling generated in the reservoir shall drastically reduce the penetration of sonic energy. However, the method shall show improvement effects in the well area and shall contribute to reduce hydraulic friction in the fluid flow. A similar method is used in the Soviet Union, aiming at cleaning the pores in the well area, with good results being achieved.

U.S. Pat. No. 3,507,330 (WILLIAM G. GILL) refers to a method to stimulate the well area with electricity only, in which electricity is passed "upwards and downwards" in the wells themselves, by means of separate conduits.

U.S. Pat. No. 3,754,598 (CARL C. HOLLOWAY, JR.) discloses a method which includes the utilization of at least one injection well, and another production well, to flow through the formation a liquid to which oscillatory pressure waves are superimposed from the injection side.

U.S. Pat. No. 3,874,450 (KERN) refers to a method to arrange electrodes, by means of an electrolyte, aiming at dispersing the electrical currents in a subsoil formation.

U.S. Pat. No. 3,920,072 (KERN) presents a method to heat a petroleum formation by means of an electrical current and the equipment utilized for such purpose.

U.S. Pat. No. 3,952,800 (BODINE) presents a sonic treatment for the surface of the petroleum well. The method, which is little practical, intends to treat the well area by means of gas injection at the production well itself, the gas being subject to ultrasonic vibrations to heat the petroleum formations.

U.S. Pat. No. 4,049,053 (SIDNEY T. FISHER ET AL) discloses different low-frequency vibrators for well installation, and which are hydraulically driven by surface equipment.

U.S. Pat. No. 4,084,638 (CUTHBERT R. WHITTING) deals with stimulation of a petroleum formation by means of high-voltage pulse currents, in two wells, one of injection and another of production. It explains also how to obtain such electrical pulsations.

U.S. Pat. No. 4,345,650 (RICHARD H. WESLEY) presents a device for electrohydraulic recovery of crude petroleum by means of an explosive and sharp spark generated close to a subsoil petroleum formation.

Although the creation of hydraulic shocks by means of a loaded capacitor is well known in the art, that invention presents an elegant vibrator as well as the advantages of utilizing shock waves to improve the recovery of petroleum.

U.S. Pat. No. 4,437,518 (WILLIAMS) teaches how to use and build a piezoelectric vibrator in a well, for petroleum recovery.

U.S. Pat. No. 4,466,484 (KERMABON) presents a method to stimulate the well area by means of electricity only, but by means of direct current, since the purpose of the invention is to enhance the effect of electricity to recover petroleum through the well-known phenomenon of electroosmosis.

U.S. Pat. No. 4,471,838 (BODINE) describes another method to stimulate a well, with vibrations, which differs from the methods previously mentioned. Here are applied also the comments of patent U.S. Pat. No. 4,437,518 (WILLIAMS). The major difference in this case is that the energy is generated by a source installed at the surface. Considering the large depth of the wells in general, this method is little feasible.

U.S. Pat. No. 4,558,737 (KUZNETSOV ET AL) discloses a bottom-hole thermoacoustic device, including a heater connected to a vibrating body. The intention is that the well area be heated and that the vibration of the heating device may activate the oil in that area, increasing thus the heat conductivity. It is a well-known phenomenon that any agitation increases the heat conductivity in a given, medium.

U.S. Pat. No. 4,884,634 (OLAV ELLINGSEN) teaches a process to increase the recovery, making the formations in the petroleum reservoir vibrate as close as possible to the natural frequency of same, so that the adhesive forces between the formations and petroleum be reduced, and, for (sic) the electrical stimulation, with electrodes installed in at least two adjacent wells. The process is achieved by filling a well within a metallic liquid to a height corresponding to the formation height, vibrating said metallic liquid by means of vibrator already installed, and at the same time effecting an electrical stimulation through the application of an electrical current to said electrodes.

USSR 823, 072 (GADIEV AND SIMKIN) deals also with a vibrating heater installed inside a well, by means of which the vibrations are intended to increase the heat conductivity.

USSR 1127642 and 1039581-A preent various vibrators to be installed in a well to stimulate the well area only.

CA 1096298 (MCFALL) presents the construction of a resonator of fluids in which a fluid flow through and around a tubular or cylindric element, installed parallel to the fluid direction, generates vibrations or vibration waves in that flow. This is only one additional way to generate waves in a well without the combination and techniques for simultaneous use of electrical stimulation. The resonator design is analogous to a whistle in which the rupture of air and its change in direction generate sound waves.

ABSTRACT OF THE INVENTION

The present invention refers to a process to recover petroleum from petroleum reservoirs, whether onshore or offshore, which includes the simultaneous stimulation of the formation by means of vibrations and electricity. The process is achieved applying special vibrations inside the layers, so that said vibrations be as equal as possitlbe to the natural frequency of the matrix rock and/or of the fluids there existing.

The present invention deals also with the vibrators to achieve such process.

An advantage of the present invention is that the process acts in the whole reservoir, making thus possible to increase its recovery factor and to restablish production in wells where same is paralyzed.

Another advantage of the present invention is that production occurs while the wells are being stimulated.

These and other advantages shall become evident to the experts in the area, as the invention is described in detail.

BRIEF DESCRIPTION OF THE DRAWINGS

FIG. 5A presents a well ready for application of the process of the invention, equipped with vibrators and connectors hydraulically driven and FIG. 5B shows a specific detail as indicated at B in FIG. 5A.

FIG. 6A presents a well ready for application of the process of the invention, equipped with a vibrator which works vertically and FIG. 6B shows a specific detail as indicated at B in FIG. 6A.

FIG. 7A presents in detail a vibrator of the invention, which also works vertically and FIG. 7B shows an electrical circuit for use in FIG. 7A.

FIG. 9E shows one additional option for the arrangement of the vibrator hammer with FIGS. 9A–9D and 9F showing specific details.

DESCRIPTION OF THE INVENTION

The basic principle of the present invention is in the elements and devices utilized to obtain the advantage of stimulating the formation combining vibration and electricity at the same time.

This is achieved introducing special vibrations in the formation layers. Those vibrations shall be as close as possible to the natural frequency of the matrix rock and/or that of the fluids.

Figure 1:
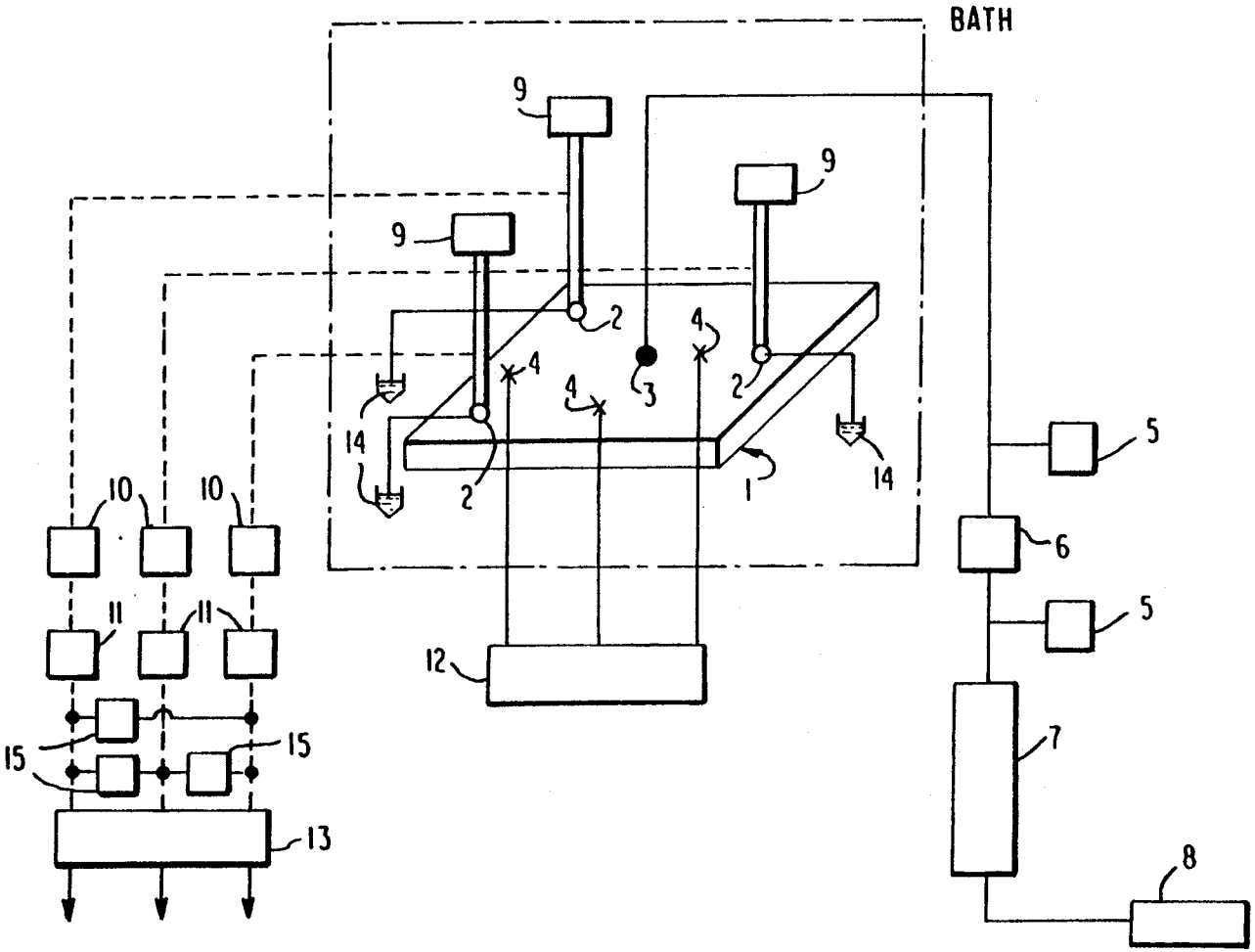
FIG. 1 shows a laboratory installation in which the test were conducted.

The confirmation of the above mentioned principle was achieved by means of tests conducted in the laboratory as shown on FIG. 1, with the purpose of simulating, in laboratory scale, the true conditions found in the formations. The tests were conducted as described below.

A sandstone block was isolated, with nearly 800 mD of permeability and 22% of porosity, taken from an outcrop, being saturated with water containing 40,000 ppm of NaCl. Thereafter, water was displaced with crude oil. The sandstone block was maintained at a temperature of nearly 38° C.

The porous medium (1) prepared as explained above was provided with three types of wells: production well (2), injection well (3), observation well-temperature (4); and equipped with pressure sensors (5, 6), temperature probes (12) and equipment for electrical stimulation (10, 11, 13, 15) and sonic stimulation (9), as well as equipment for feeding gas (7) and liquid (8) to the system.

The tests were repeated several times utilizing the different arrangements of vibrators and electrical power supply, and accompanying the effect of the stimulation utilizing vibration only, electricity only, and vibration and electricity simultaneously. The oil recovered was collected in flasks (14).

It was verified that the vibrations generate various effects in the fluids retained in the formations:

a) they release the cohesive and adhesive links, as well as a large part of the capillary forces, allowing thus the hydrocarbons to flow through the formation;

b) the vibrations which propagate inside the reservoir in the form of elastic waves shall modify the contact angle between the formation and the fluids, and shall reduce the coefficient of hydraulic friction. Thus, an easier flow towards the wells shall take place, where a drastic increase in the velocity, as well as a larger pressure drop, shall occur;

c) the elastic waves generate an oscillatory force in the layers, and, due to the different densities of the fluids, these accelerate differently. Due to the different acceleration, the fluids shall "rub" each other and generate heat by friction, which on its turn shall reduce the interfacial tension of the fluids.

In addition to those effects, the vibrations shall release the gas which was caught, which shall contribute to an expressive increase in oil pressure.

In addition, the oscillatory force shall create an oscillatory sonic pressure which shall contribute to the oil flow.

To maintain, and at the same time increase the field pressure, when the natural pressure has decreased, heat is applied to the reservoir. Heat is applied both in the form of friction heat, caused by vibrations, and in the form of alternating current supplied to the wells. Due to the capacity of electrical current transmission, always present in the reservoir, the current shall circulate in the wells and make the reservoir act as if it were an electric furnace, a resistive heating being consequently obtained.

The heating shall cause the partial evaporation of water and of the lightest fraction of petroleum hydrocarbons.

The alternating current shall make the ions in the fluids oscillate and thus create capillary waves in the surface of the fluids, thus reducing the interfacial tensions.

The total heat generated both by the electrical stimulation and by the vibrations shall reduce the viscosity of the fluids (or shall render them thinner).

Both the vibrator and electricity are placed in the petroleum producing wells and, thus, the oil which flows acts as a refrigerating medium, which allows the utilization of a large energy density.

Figure 2:
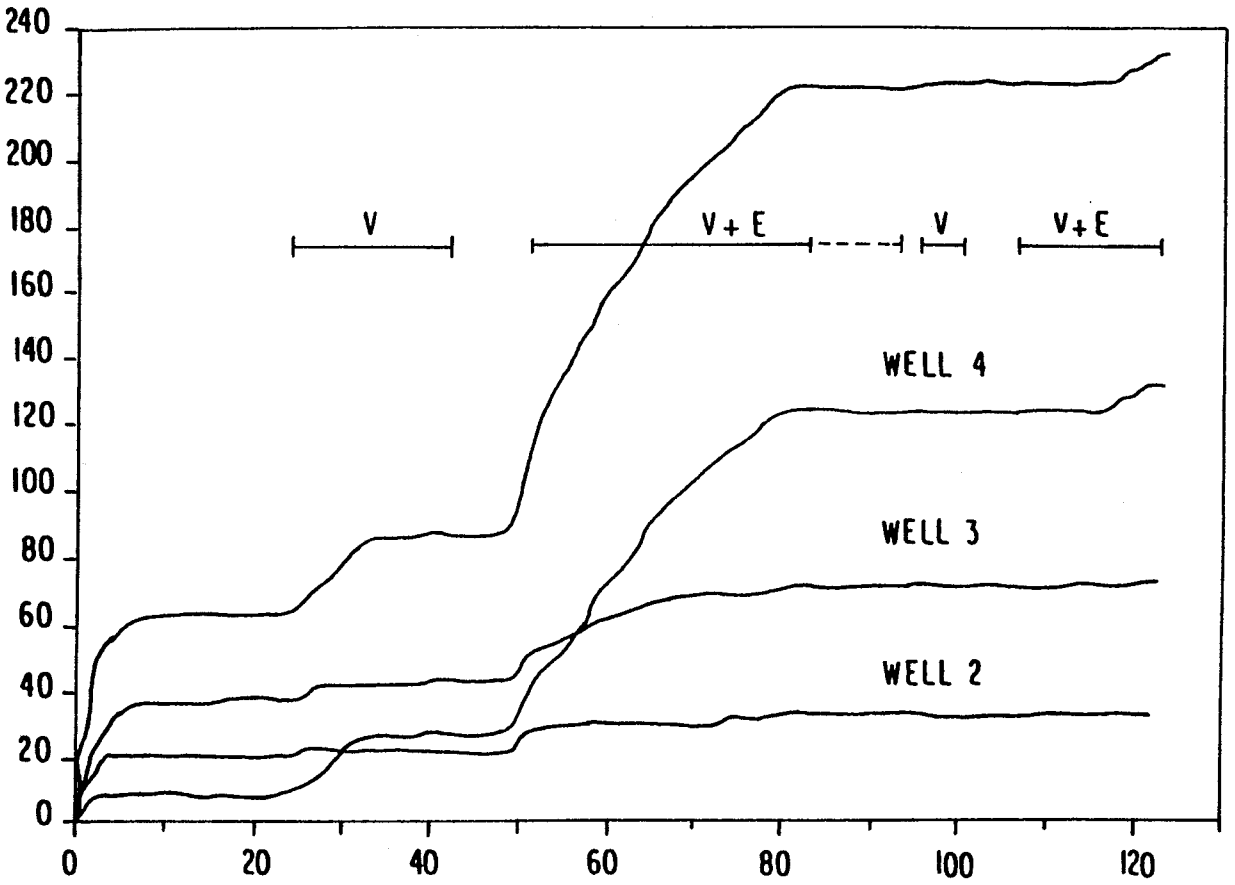
FIG. 2 presents the results of tests in laboratory scale conducted at the installation shown on FIG. 1.

These basic facts were verified by means of tests conducted in laboratory scale and based on the principle previously described. The results of one of those tests are represented on FIG. 2.

The graph shows the oil recovered from the production wells, as a function of time. The production of each well, the total production, and the type of stimulation applied during the tests, were traced, as follows: V represents the vibrations only, E represents electricity only, and V+E represents vibrations plus electricity. After 80 hours the test was interrupted and later on restarted. Even so, the results were expressive.

The graph indicates that, with the process of the invention, 3.5 times more than in the primary recovery was recovered. The results of the previous tests were nearly equal.

What is important to observe in this test is that a drastic increase in oil production occurred with the stimulation by means of the simultaneous application of electrical and vibrational energy. Oilproduction occurred more than expected for the thermal effect by means of pressure increase and drastic changes in viscosity only. This confirms the theory that the surface tension decreases with the oscillation of the ions in the fluids, which generates a fast increase in oil flow, together with acoustic stimulation, which accelerates the droplets.

It is necessary to explain better how the sound waves can affect petroleum production and what has been verified in our intensive laboratory research.

The movement mechanisms in a reservoir can be as follows:

1. Fluid and matrix expansion.
2. Water displacement.
3. Gas displacement.
4. Solution-gas displacement.

The invention may be utilized together with all those mechanisms, but its results are best in the case of solution-gas displacement.

In case of gas dissolved in oil, the gas expands in the form of small droplets inside the oil as pressure decreases, or as the reservoir is heated when pressure is below saturation pressure.

The gas bubbles shall displace the oil, which shall flow inside the reservoir towards the pressure drop. The oil droplets are usually surrounded by water and very few solid particles exist in which the bubbles can grow. In this case an increase in the bubble point shall occur in accordance with the increase in the boiling point, and the pressure in which the bubbles are formed shall be substantially lower than for a given temperature. Therefore, it is necessary that the pressure be reduced for the bubbles to be able to start growing on the microbubbles which may be present in the liquid. It has been shown that the acoustic vibrations interact with the increase in the bubble point, so that boiling may more easily start.

In addition, the surface tensions in the limit between oil and gas shall prevent the oil from flowing inside the reservoir. Those surface tensions in the limit between oil and gas are relatively low and decrease as temperature increases. Therefore, a very large effect shall be achieved with relatively weak vibrations.

Our laboratory tests showed that, from the rock matrix in which the flow stopped, it is possible to restart the flow with a vibration as weak as 0.04 g. With this a recovery of up to 80% of the residual oil has already been achieved.

The explication for that is that when the oil flow stops it is because a point of equilibrium has been reached, which can be altered by means of a weak acoustic stimulation.

As sound oscillations propagate in the radial direction of the well and oil flow towards the same, an optimum effect shall be achieved with the utilization of a minimum amount of energy.

In addition it is known that oil, and other fluids, flow more easily through a porous medium when said medium is affected by vibrations, a fact which is attributed to the reduction of hydraulic friction in the pores. It is thus explained why a liquid considered as Newtonian acts as if it were a thixotropic fluid in small droplets. In the limiting area between the liquid which flows and the limits of the pores, the molecules shall become "aligned" with some molecules in the thickness, according to their higher or lower polarity.

If the liquid is subject to vibrations one reaches what is referred to capillary waves in the fluid, and then the molecules shall not have the time to as establish polar links. The thixotropic layer becomes thinner and the oil shall flow more easily. This phenomenon shall interact with the oscillatory movement of the ions in the same surfaces, and shall thus be superimposed to the capillary waves created by the vibrations.

The energy in the sound wave which is absorbed by the reservoir shall be transformed into heat and shall therefore increase the gas pressure as a consequence of the partial evaporation already mentioned previously, together with the electrical stimulation.

It is a great advantage that the heat be generated in the reservoir itself and that it does not have to be transported up to the layers, by conduction, by means of a heat-carrying medium, such as steam, hot water, or equivalent.

At the time of water breakthrough in the producing wells, it is usual to occur that large quantities of oil be retained in the reservoir due to the action of the capillary forces. Oil recovery has been already achieved in these conditions, by means of sonic stimulation, but it was required to utilize strong vibrations (5–10 g).

U.S. Pat. No. 4,884,634, previously mentioned, presents a system to achieve stimulation in a petroleum reservoir by the simultaneous utilization of electrical and sonic means. It shows the main utilization of 3-phase electricity transported into the wells with one or more vibrators immersed in a conducting liquid, placed in the same wells, a liquid which may be mercury. It shows the advantage of making the conducting liquid oscillate as if it were a rope with several knots, so that the waves propagate into the reservoir as shells which expand and are superimposed to each other, creating a "hammering" effect inside the layers.

This patent, however, does not deal with the details concerning the application of such a principle when the wells are old and the equipment installed in same are of standard type.

This means that the process of the present invention innovates in the utilization of conventional production facilities and tools, and in that the surface electrical system avails itself of usual equipment, such as commercial transformers available in the market.

When trying to utilize the principle above in a reservoir, the following problems must be taken into account:

1. energy dissipation in the formations;
2. energy conduction up to the vibrators;
3. control of total energy consumption;
4. obtainment of electrical and acoustical connection with the well casing and of that with the reservoir, so that the use of a conducting liquid may be dispensed with;
5. availability of vibrator which is simple and durable, and which does not suffer from the instability usual in the vibrators already known.

The present invention has as its purpose to solve the problems mentioned above, allowing the process to develop in a practical way and to be adaptable to practically any type of reservoir.

Another purpose of the present invention is to conduct the energy up to the formations at the bottom of the hole, with or without special electric cables, as well as to utilize said energy to make the vibrators work.

Another purpose of the present invention is to interconnect the vibrator to the regular production tubing, making the electrical connections operate with or without hydraulic pressure in the tubing.

Still another purpose of the invention is to allow the vibrator to be tuned at different frequencies and transmit the so-called "pink sound".

The purposes of the invention are met through the alternatives which shall be described as follows:

An alternative consists of conducting the electrical current through an electric cable installed in the annulus between the production tubing and the casing. The electrical connection is achieved by means of connectors, on a separate connector, which are installed either on the vibrator or connected to the uncovered end of the electric cable.

Another alternative consists of conducting the electrical current through the production tubing, centralized in the casing by means of special non-conducting centralizers. In this option the annulus may be filled with isolating oil to avoid any electrical connection with the casing.

A third alternative consists of conducting the electrical current through the isolated casing, isolating the production tubing with the centralizers.

As regards the vibrator it may receive energy from the main feeding source. This energy shall feed initially the vibrators and then, through the connectors, it shall pass to the casing, penetrating until the petroleum formation, or viceversa.

The vibrators may also be fed as from the main feeding source, draining the energy from the main source to the vibrator, at a chosen pulse. This means that the main feeding usually by-passes the vibrator, but is conducted to the same when this is activated. This can be controlled from the surface or from the bottom of the hole by a discharge device.

The electrical isolation which remains above the petroleum formation may be achieved by cutting the casing at a short distance above same and filling the cavity with some type of isolating material, for instance, epoxy, isolating oil, or similar; a fiberglass coating may be utilized above the petroleum formation.

DESCRIPTION OF THE PREFERRED REALIZATION

With the purpose of making easier to understand the invention, reference is made to FIGS. 3 through 14.

Figure 3:
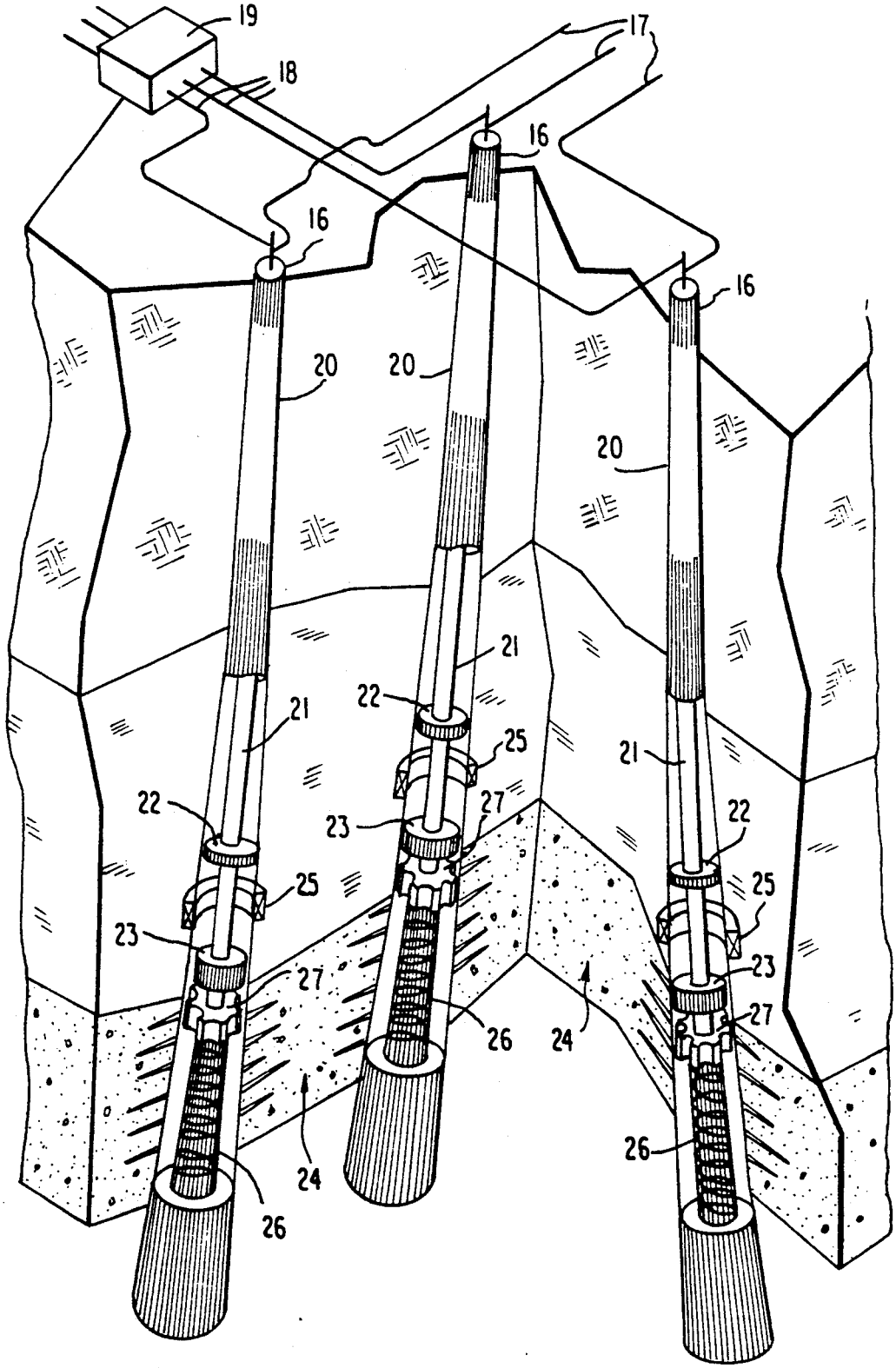
FIG. 3 shows a schematic arrangement of three wells equipped with vibrators, to achieve the process of the invention.

FIG. 3 shows a general arrangement of three wells equipped with their conventional elements, well-known to the experts, such as wellhead (16) and flow lines (17) to the oil tank. From a 3-phase power source of generator or transmission line type, and starting from transformers and control units (19) come out the feeding cables (18) towards the wells. A standard casing is aligned at the well bore, the production string (20) being centralized inside the casing by means of centralizers (22). At the end of the string is a packer (23), known to the experts. The casing is cut at a certain distance (25) above the producing layer (24).

The cavity can be filled as from the cut with isolating epoxy or similar.

Below this point the vibrators (26) remain suspended from the production string (21). The current which flows through the vibrators, or by-pass the same, enters the part of the casing which penetrates the petroleum layers, by means of connectors (27) hydraulically driven, or of a mechanical connector made of a supporting device at the bottom of the hole.

Figure 4B:
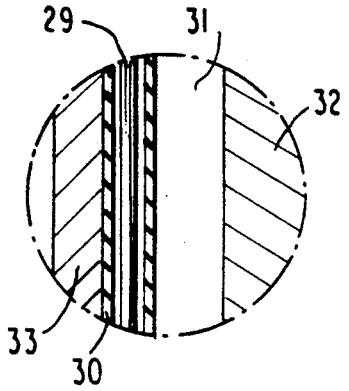
FIG. 4A constitutes a view of the bottom-hole electrical circuit with FIGS. 4B and 4C showing specific details as indicated at B and C in FIG. 4A.
Figure 4A:
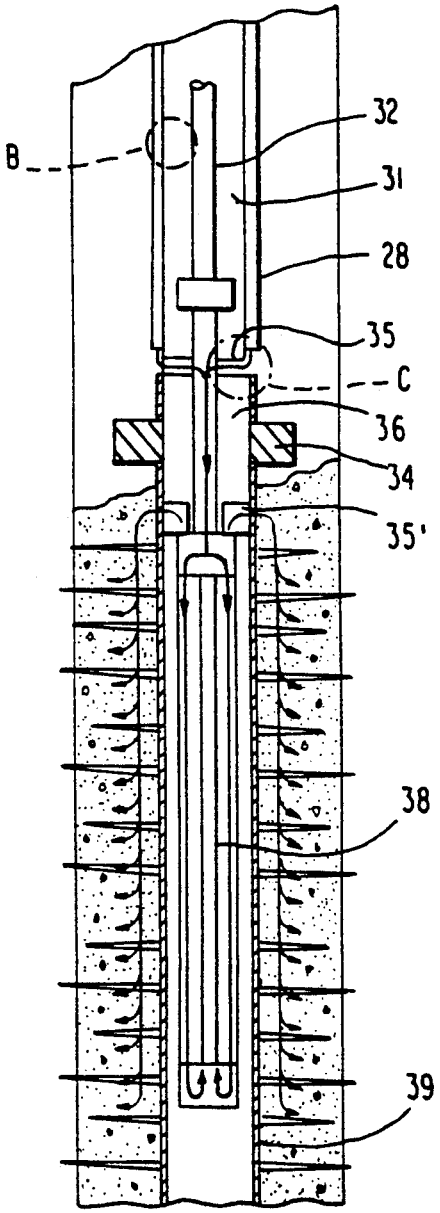
Figure 4C:
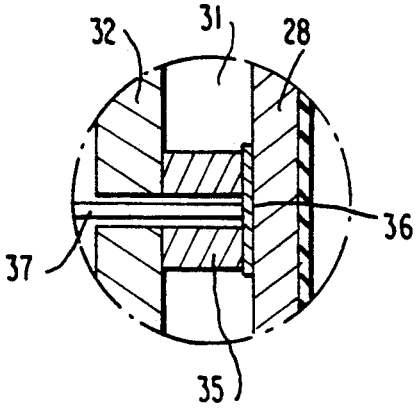

FIG. 4A presents a typical view of the electrical circuit at the bottom of the hole.

The power source above illustrated may feed alternatively the externally-isolated casing (28) or an electrical cable (29) provided with reinforcement (30).

When the current is conducted by means of the electrical cable, this cable remains in the annulus (31), established between the production string (32) and the internal wall (33) of the casing, as shown in detail A.

When the current is conducted by means of the externally-isolated casing (28), an electrical connector (35), which works hydraulically, remains attached to the string (32) and makes the contact directly in the internal area (36), not isolated, of the casing (28), located above the isolation bridge (34).

The current which leaves the conducting casing (28) through the conduit (37), or the electrical cable (29), flows through the vibrator (38) and enters the lower casing (39) by another connector (35') which works also hydraulically.

FIG. 5a shows a well prepared for the process of the invention, being provided with an isolated casing (28) as conducting element, and a vibrator (26) with connectors (40, 41) which work hydraulically. In addition, the well bore is enlarged at the petroleum layers (24), as it is well-known in the area, and the cavity (42) is filled either with salty concrete and drilled or with spheres in aluminum or another metal, or else with another material of high conductivity, such as a metallic or non-metallic conducting liquid, aiming always at increasing the area of the electrode and providing a good acoustic connection with the formation.

FIG. 6A presents the same arrangement as on FIG. 5A, except that the vibrator (43) oscillates vertically.

The main problem during the development of the process consists of designing and constructing vibrators which are reliable, inexpensive and durable, which can be synchronized at the natural frequency of the formation, as defined in "RANDOM VIBRATION IN PERSPECTIVE", by Wayne Tustin and Robert Mercado, Tustin Institute of Techology, Santa Barbara, Calif., on page 187:

> "NATURAL FREQUENCY, $f_n$—the frequency of the free vibrations of a non-muffled system; also, the frequency of any type of the normal vibration modes. $f_n$ decreases in case of muffling".

Due to the muffling (attenuating) properties which are always present in any reservoir, and which can be evaluated by the Formation Quality Factor, it may be verified, through the work presented by Yenturin A. Sh., Rakhumkulov R. Sh., Kharmanov N. F. (Bash NlPlneft't), Neftyanoie Khozvaistvo, 1986, No. 12, December, that the effective natural frequency is in the range of 0.5–5 Hz, and that it can provide an acoustic pressure pulse of 2–20 MPa, depending on the pressure prevailing in the reservoir.

However, we verify that this frequency can reach nearly 100 Hz, and, as an example, we may mention a Brazilian petroleum field, where the pressure is 16.7 bar (1.67 MPa). It has been verified in this case that the optimum average sound pressure was 304 KPa, which results in a pressure gradient in the casing of 108 KPa and an acceleration of 5 g. We have thus a vibrator with an average power of 100 kW = 18 kW/m$^2$. At 5 Hz this may generate a maximum intensity peak of 362 kW/m$^2$ and a sound pressure of nearly 5 MPa.

The low frequency herein described generates elastic waves of deep penetration. But, since it would be advantageous to have available frequencies well higher close to the well area, to achieve the effect of emulsification and then contribute to a lower hydraulic friction, this question is solved making the vibrator transmit what is referred to as "pink sound", which means noise containing many frequencies, which is by the way the case of most noises. For instance, recording the low-frequency noise of given musical instruments, such as drums, it can be verified that there is a number of different frequencies at the upper part of the low-frequency wave.

Since the effect of muffling in the reservoir shall absorb the low frequencies immediately around the well, our purpose is automatically reached by transmitting low-frequency "pink sounds". No method known for stimulation with vibrations has already called attention to this point.

In petroleum well logging operations a series of vibrators are known which can transmit high powers at various frequencies. None of such equipment, however, has shown to be adequate to the purposes of the present invention, since same have not been designed for continuous utilization. In addition, they do not allow for the associated use of electrical stimulation, nor can they be fed as from the main power source towards the wells.

consequently, it was necessary to design special electromechanical vibrators to meet the requirements of the present invention. To reach this purpose it was verified that it would be required to convert electrical energy to magnetic energy, and this to kinetic energy in a body, and hence in a high-power acoustic pulse. Such electromechanical vibrators are presented on FIGS. 7 and following ones, which we shall describe as follows.

FIG. 7A shows a vibrator which works vertically, including a series of coils which, upon being energized, press a tube polarized in the holes of the coils, which transmits the kinetic energy thus generated to a hammer (44) which alters the direction of the movement in elastic waves. This is achieved by means of the following elements shown in FIG. 7B: the coils (45) are connected in series, and to a full-wave rectifier (46); the rectifier (46) is connected to the main conductor (47) which, in the present case, consists of the production tubing (32) and the lower part of the casing (39). Above the rectifier (46) is a general switch driven by thyristor (48). This switch opens at a given frequency by means of a time circuit (49). As the switch (48) opens, the direct current flow towards the coil and the magnetic fields then generated in the coils pull the polarized tube (50) downwards. A sensing coil (51) accompanies the end of the path and closes the switch again, and a spring (52), or the pressure inside the reservoir, shall pull the polarized tube (50) upwards again. The oil flows through the polarized tube and drags the heat generated in the coils.

A detailed description is presented as follows of the hammer device (44) which receives the stroke of the polarized tube (50).

Figure 8A:
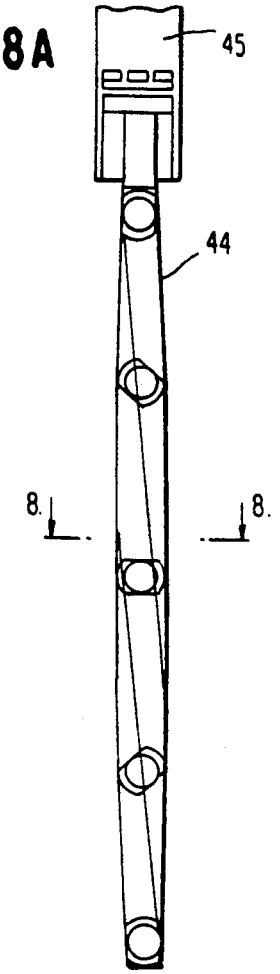
FIG. 8A is a sectional view along A—A in FIG. 8
Figure 8B:
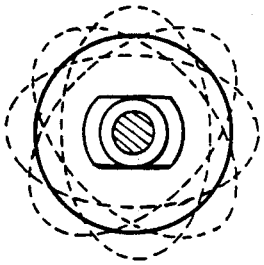
FIG. 8B shows specific details of the hammer.
Figure 8C:
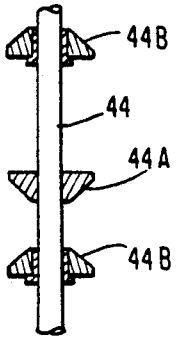
FIG. 8 shows another option for the arrangement of the vibrator hammer.

FIG. 8 and FIGS. 8A and 8B shows an alternative for the hammer device (44), which includes a bar (44) with V-shaped bodies (44A) attached to the bar (44). At a certain distance below the V-shaped bodies (44A) are placed moving bodies (44B, the upper part of which is V-shaped. The bodies may have different formats and thus create different wave patterns as the bar is pressed into the liquid. The waves shall be generated as the fluids between the moving bodies (44B) and the fixed body (44A) are pressed radially outwards, since the high acceleration of the bar downwards makes the bodies be pressed against each other at high speed. By placing the opposite sides of the bodies parallel to the bar, it is possible to make the casing bend axially as seen in detail A—A. The great advantage of this is that much less force is required to deform the casing like that than when steel is pulled, as it occurs with the utilization of a vibrator which sends bundles of forces in all directions and at the same time. By allowing the sides of the bodies to follow a long spiral, as seen in the drawing, it is possible to make the casing oscillate as a musical instrument string, thus transmitting bundles of superimposed waves into the layers.

On the other hand, the polarized tube can hit any construction which may change the direction of the vertical movement of nearly 90°.

Another hammer device is presented on FIGS. 9A-9F. The expansion element in this case is a flexible tube which consists of an axially corrugated steel tube. The extremity of the expansion element which is pointed downwards is closed by a cover (53). In the other extremity the tube (54) is connected to a terminal part (55) where a piston (56) exists. The piston (56) can be pushed by the polarized tube (50) shown on FIG. 8, into the expansion tube (57), which is filled with a liquid. The piston (56) returns from its course by means of the spring (52) or by any other elastic means. The expansion tube may have any other format, as seen in details A, B, C and D, and all of these shall generate different wave patterns and shall allow the casing to bend axially as mentioned above.

Another vibrator utilizes the vector product between the electrical and magnetic flows, which results in a perpendicular force F, which is the base for all electrical motors, availing itself of the electrical current itself used for the wells. This alternative is described in accordance with FIGS. 10A and 10B, where a core (57) exists, built of rolled steel sheets, as in the armature of a motor. Surrounding the core, a coil made of isolated copper wire (58) is placed, both the core and the windings being protected by isolation (59). For the expansion element various options exist, of which four alternatives are presented.

In a first option the expansion element (6) is a corrugated tube made of stainless steel. The annulus between the tube (60) and the isolation (59) is filled with a high-conductivity liquid, for instance, mercury. Instead of utilizing a corrugated pipe, we may replace it by a flexible hose (61) made of silicone rubber.

Another option for the expansion element is the tube (62), divided into four elements (63). In the interval between the poles (64) an iron bar exist (65) attached to said tube (62). The tubes (62) are maintained united by means of an elastic silicone hose (66).

Still another option is that of a corrugated tube (67) of special format.

The operation of the vibrator is described as follows.

The current i from the conductor of the well passes first by the coil (68) and generates thus a magnetic flow B between the poles (63, 64). Thereafter the current passes by the expansion element (in the first two options—by the conducting liquid), and then into the formation. The circuit is arranged so that the force F may actuate against the casing and the formation. As the direction of the current and of the magnetic field changes, due to the alternating current frequency, the frequency of the vibrations shall duplicate. That is to say, if a 50 Hz frequency exists for the current, the frequency of the vibrations shall be 100 Hz.

In some reservoirs this may be the optimum frequency, and therefore it shall not be required to maneuver the force to the vibrator. But, should it not be advantageous to utilize a lower frequency, the force may be fed as described for FIG. 7B or by transmitting a high-voltage pulse as from the surface, which makes the current pass by the coil in the vibrator and hence into the formation. This force may be fed also as from a loaded capacitor, or from a loaded coil, as in the ignition system of a car.

Figure 11A:
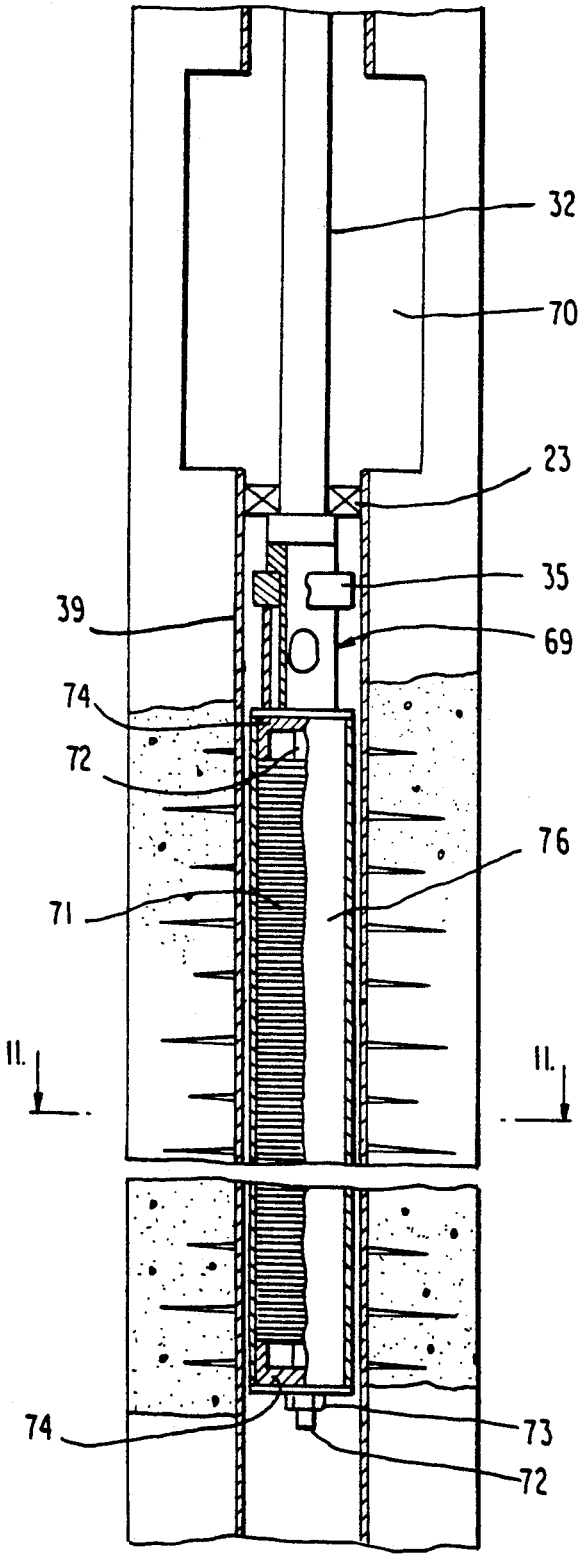
FIG. 11A is a sectional view taken along the line A—A in FIG. 11.
Figure 11B:
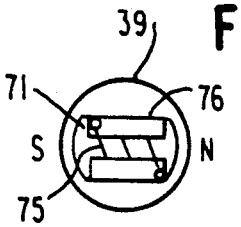
FIG. 11 also presents other options for vibrators.

FIG. 11 presents another option for a vibrator.

The coupling scheme (69) shows the connector (35), hydraulically operated, attached to the extremity of the production string (32) with its packer (23) isolated, below the enlarged area (70). The vibrators are also seen, in the form of a core (71) composed of iron sheets united by means of a bolt (72) with its nut (73). In each extremity of the core two terminal parts (74) exist which press the bundle of rolled iron sheets forming the core (71). Around the core a coil (75) of copper wire is wound which, upon being energized, generates a magnetic field with north and south poles in each side of the core, as seen in the section view of FIG. 11A. In order to protect the coil and the core, same are placed inside a non-magnetic tube (69) with the format shown. The spacing between the core/production tubing set (76) and the steel casing is nearly 1 mm.

The operation of this vibrator is as follows: as the current passes by the coil and then by the connector (35), and into the formation, an oscillating magnetic flow B is generated in the coil, which changes in direction in accordance with the frequency of the current. Since the oscillating magnetic flow shall attract the casing in the same direction, it shall vibrate twice more than the frequency of the power source, according to FIG. 11A, due to the spring in the steel. This results in the same advantages pointed out in relation to the movement of the casing dealt with above, for the expansion element of the vertical vibrator described on FIG. 7A.

For the case of large thicknesses of the producing formation, the core of FIG. 11 may be twisted and it shall be thus possible to make the casing vibrate, transmitting wave trains as from the casing, and superimpose the knots, Should it be required to utilize a frequency lower than that of the electrical current, this may be obtained in the same way as that described for the vibrator of FIG. 7B, which energizes the coil with high current pulses. It is also convenient to point out that all the shocks generated by the vertical vibrator automatically generate pink sounds. To achieve these pink sounds in the vibrators which transmit horizontal shock waves, and which vibrate twice as much as the frequency of the power source, a frequency modulator is used. In its simplest form this may be done with a tape recorder whose signal is amplified by a transformer. We may verify that it is thus possible to utilize special "music" for frequency modulation.

In the case of the vibrator which actuates in accordance with the principle described on FIG. 11, it may be advantageous to build it with a special expansion element which vibrates instead of the casing. This is achieved installing the coil set (72) inside an additional flexible tube which may be put to vibrate. The format of this expansion tube may be round or elliptical.

Figure 12:
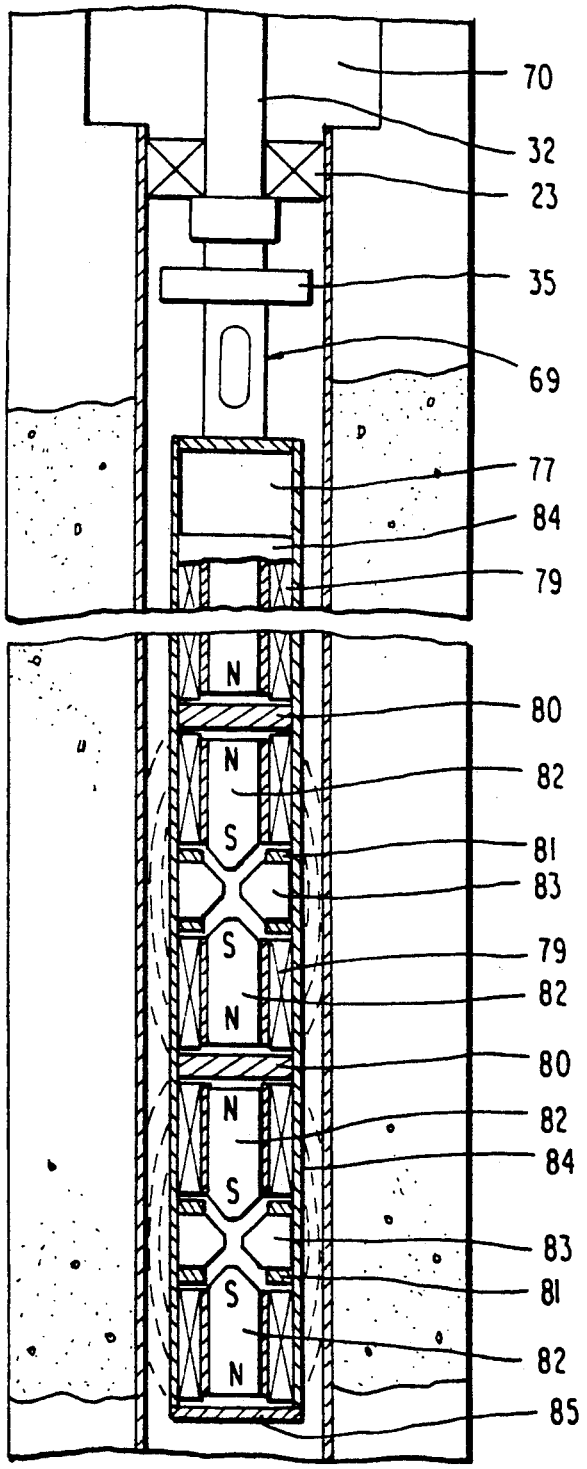
FIG. 12 also presents other options for vibrators.

FIG. 12 shows still another vibrator. The coupling scheme (69) presents the connector (35) hydraulically operated, attached to the extremity of the production string (32) with its packer (23) isolated, below the enlarged area (70). Below the coupling (69) a void space (77) exists, intended for the switches which control the vibrator (78). The vibrator consists of a series of coils (79) attached to each other by means of spacers (80) and sections of tube (81). At the central hole of the coils, for each pair of coils, two iron pistons (82) are placed, with their extremities turned to each other and cut in parallel according to a 45° angle. The coils are wound so that near each pair of pistons, the magnetic poles which are turned to each other remain in the south and north directions. The plane extremity of the pistons (82), turned to the piston of the other pair of coils, has the same magnetic pole. A hole is drilled in the sections of pipe (81), in which two small pistons (83) are placed in opposite direction, and the extremity turned to each other is cut in parallel at a 45° angle. The coils with their pistons are placed in a steel tube (84) which is closed at the bottom by a plate (85).

The function of the vibrator is to transmit an electrical current into the coils, which shall generate magnetic fields and the above mentioned magnetic polarities. The pistons (82) shall attract to each other and press the small pistons (83) radially outwards. The vertical movement of the pistons (82) and, therefore, the kinetic energy absorbed as the pistons (83) are reached, shall be transformed into acoustic energy as the steel tube (84) is bent. Without using an expansion pipe (84) the power will be transmitted from the radial pistons (83), as a burst.

Each extremity of the pistons (83) shall transmit elastic waves of high power an low frequency. Even though the magnetic field increases slowly, the sudden impact on the extremities of the piston (83) shall make possible the generation of pulses of several kW.

These statements are supported by the following equations.

For calculus purposes, the magnetic flux density in the air gap between the poleshoes is assumed homogeneous. Also, the residual magnetic field in the ferrous material, the current induced by the frequency fluctuation in the magnetic field and the magnetic losses in other parts of the circuit are assumed negligible.

The Ampere Law shows that:

$$\phi H\, dl = I$$

where:
H=magnetic field strength
l=circuit length
I=electric current

The magnetic force may be expressed as:

$$F = \frac{dW}{dx}\ \frac{1}{2}\ \frac{B^2}{\mu} \cdot A \qquad (1)$$

where:
F=magnetic force
W=magnetic power
x=field displacement
B=magnetic flux density
A=transversal area of the magnetic circuit
$\mu$=magnetic permeability Then, the magnetic field is:

$$\phi H\, dl = I_{total}$$

$$\phi H_{Fe} dl + 2H_{air}\delta = NI$$

where:
$\delta$=size of the air gap
N=number windings in the coil

Assuming $H_{Fe} \simeq 0$, we will have $2\, H_{air}\, \delta = NI$ (2)

Thus:

$$H_{air} = \frac{1}{2}\ \frac{NI}{\delta} \text{ and } B_{air} \frac{1}{2}\ \frac{NI}{\delta}\ \mu_o \qquad (3)$$

Combining equation (3) into equation (1):

$$F = \frac{1}{2}\ \frac{B^2}{\mu} \cdot A = \frac{\mu_o}{8}\left(\frac{NI}{\delta}\right)^2 \cdot A \qquad (4)$$

This equation shows that the magnetic force increases according to a parabola, as an inverse function of the air gap size. This indicates that the force will dramatically grow until the impact moment.

Considering, for project purposes based on FIG. 12, the following values

A=0,02 m$^2$; N=1000; I=5 Amperes; $\delta_{max}$=0,01 mm; m=5 kg the magnetic force corresponding to each position of the piston and the accumulated power at the end of piston travel, can be calculated. The results are shown in Table I.

TABLE (I)

| $\delta_x$ [m] | $F = \frac{\mu o}{8}\left(\frac{NI}{\delta}\right)^2 \cdot A$ [N] | $a = \frac{F}{m}$ [m/s$^2$] | $v = v_o + \sqrt{2as}$ veloc. at $\delta_x$ [m/s] | $E = \frac{1}{2}\, mv^2$ [kW] |
|---|---|---|---|---|
| 0,0100 | 785 | 157 | 0,18 | 0.08 |
| 0,0090 | 970 | 194 | 0,38 | 0,36 |
| 0,0080 | 1300 | 260 | 0,61 | 0,93 |
| 0,0070 | 1600 | 320 | 0,86 | 1,85 |
| 0,0060 | 2180 | 436 | 1,16 | 3,36 |
| 0,0050 | 3140 | 628 | 1,51 | 5,70 |
| 0,0040 | 4900 | 980 | 1,95 | 9,50 |
| 0,0030 | 8700 | 1740 | 2,54 | 16,13 |
| 0,0020 | 19600 | 3920 | 3,43 | 29,41 |
| 0,0010 | 78500 | 15700 | 5,20 | 67,60 |
| 0,0005 | 314000 | 62800 | 8,75 | 191,18 |

At the impact point ($\delta$=0), the power should be infinite. However, a realistic value can be estimated as 100 Joules and the time for dissipation this energy 0.001 second. Thus, the power per plunger will be:

$$W = \frac{100}{0{,}001} = 100 \text{ kW}$$

Each train of waves of the small pistons (83) will be superimposed on the others, since the waves will be superimposed on each other.

The arrangement of coil set (79) and pistons (82) shown in FIG. 12 results in an axial movement of said piston. However, it can be advantageous to turn coil/-piston assembly by 90° so as to obtain a radial movement of the piston.

Figure 13:
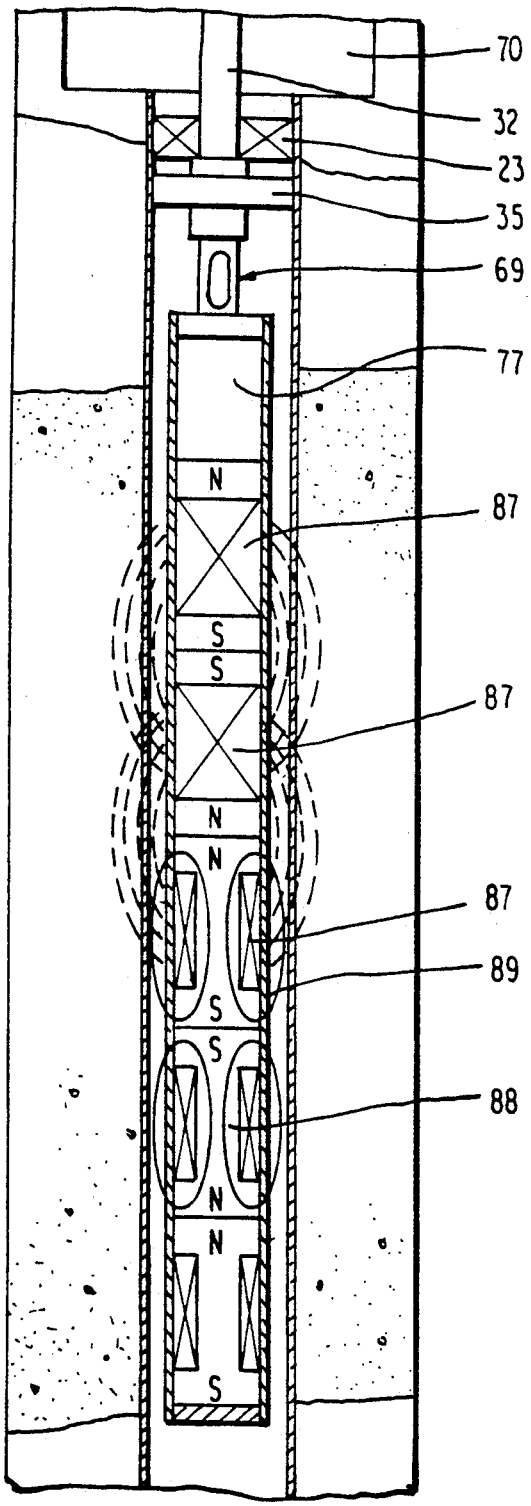
FIG. 13 also presents other options for vibrators.

Still another alternative for the vibrator is presented on FIG. 13. The coupling scheme (69) shows the connector (35), hydraulically operated, attached to the extremity of the production string (32) with its packer (23) isolated, below the enlarged area (70). Below the coupling (69) is a void space (77), intended for the electrical switches of the vibrator. The vibrator consists of a series of coils (87) wound around a core of iron sheets (88) so that each magnetic pole in the extremity of the coils is identical. This means that the north pole of a coil is turned to the north pole of the other, and the south pole is turned to the south pole of the following coil. The cores of rolled iron (88) are formed so that each iron extremity of the coil is equal in each coil. The set of coils, in one of the possible arrangements, is placed in a square hollow tube (89) of elastic magnetic material, like a steel spring with a space for the coils (87) and the rolled iron core (88). In another arrangement, the tube is circular (90) and of the same type of material, and therefore the extremities of the rolled cores turned into the tube are circular. It must be understood that it is possible to utilize rolled tubes where the internal tube is made of an elastic magnetic material and the external is made, for instance, of stainless steel.

Figure 13B:
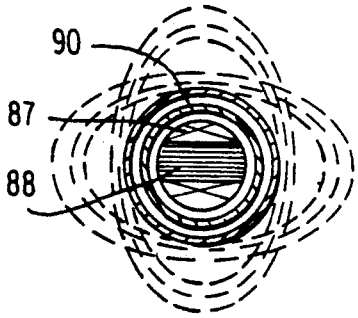
FIGS. 13A and 13B show specific details of FIG. 13.
Figure 13A:
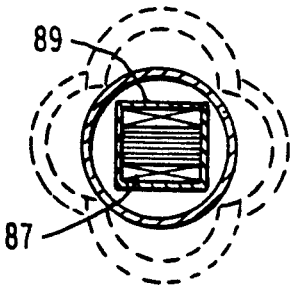

The operation of this vibrator is described as follows. When the electrical current passes by the coils (87) and then by the connector (35) and into the formation, an oscillating magnetic flow B is generated at the coils, which changes in direction with the frequency of the current. By the fact that the magnetic poles in the coils are turned to each other, a closed magnetic circuit shall be obtained for each coil, as shown of FIG. 12. Since the oscillating magnetic flow shall attract the tubes, it shall vibrate twice as much as the frequency of the main fource. Since the attracting is stronger between the coils, the set shall transmit a number of wave trains larger than the length of the vibrator. Each wave pulse shall have, in its vertical projection, the format shown on FIG. 13, and in its horizontal projection, the format illustrated in FIGS. 13A and 13B. The advantages of this are the same as presented for the movement of the tube and, therefore, of the casing as mentioned for the expansion element of the vertical vibrator of FIG. 7. It must be pointed out that it is possible to attract the casing directly without using the expansion tubes (89) or the non-magnetic tubes as protectors of the coils.

Figure 14:
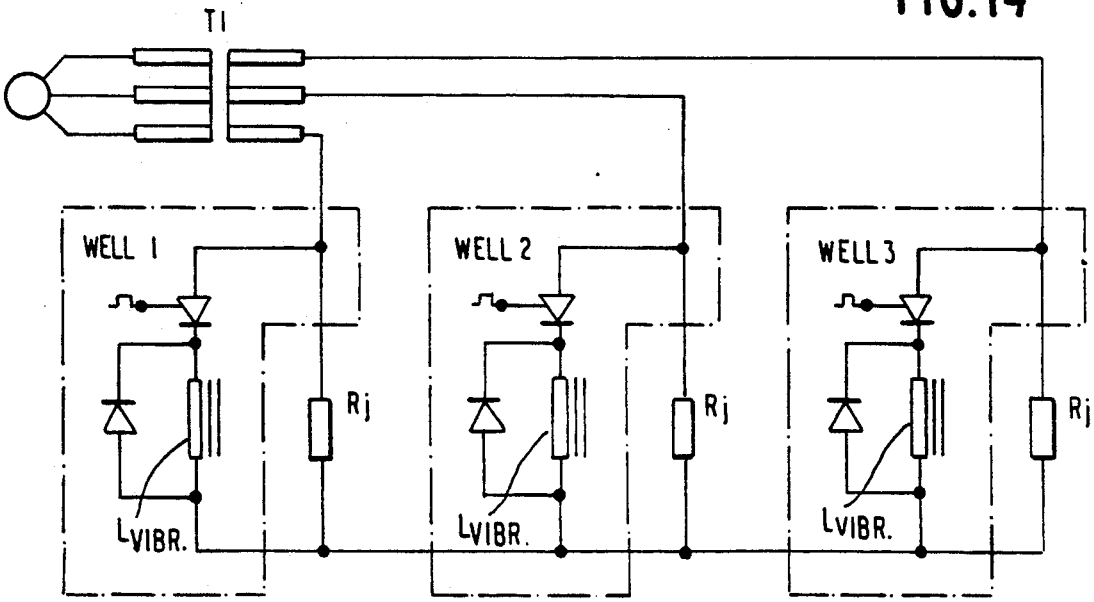
FIG. 14 presents a schematic diagram for obtainment of low-frequency sounds.
Figure 10A:
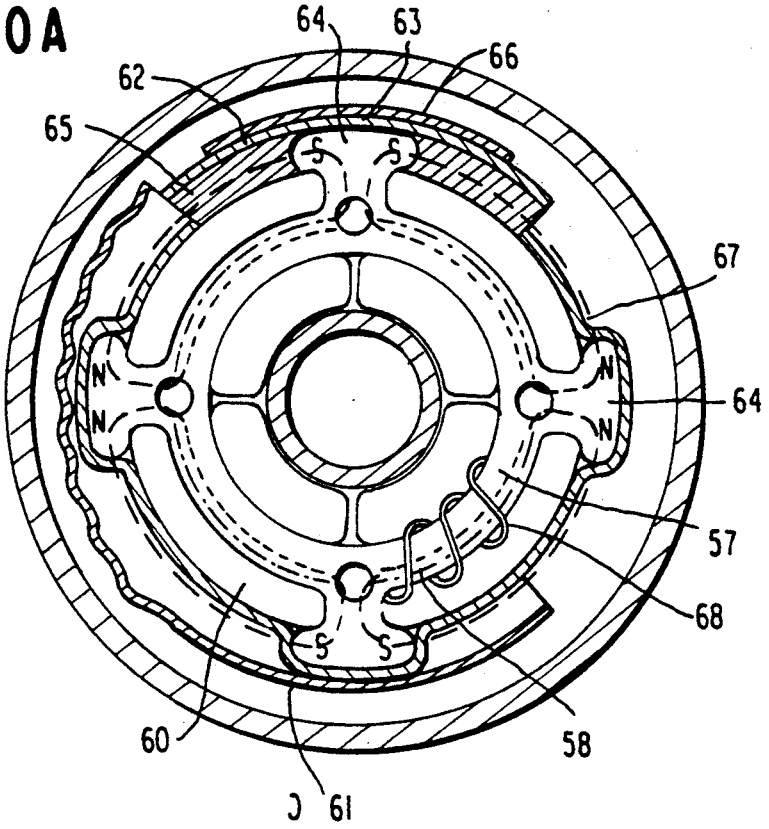
FIG. 10A presents details of another vibrator in cross-section and FIG. 10B shows a specific detail of FIG. 10A.
Figure 10B:
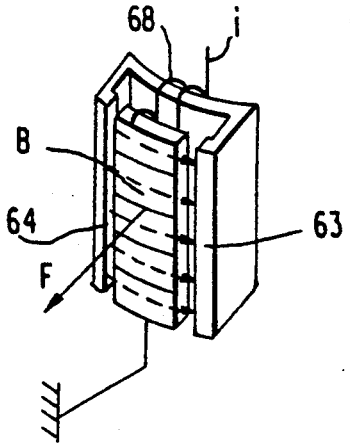

To reach the low frequency, this may be achieved as for the vibrator of FIG. 7B or as shown in the scheme of FIG. 14.

The direction of the main current which is heating the formation (Rj) may be changed by means of a thyristor adjusted at a frequency to pass through the vibrator and then activate the coils.

With the use of rolled tubes, in which the external tube is non-magnetic, the magnetic tube attracted shall reach the external tube as it returns, after the magnetic force ceasing, and it shall then generate a sharp pulse as that described for the vibrator of FIG. 12.

In addition, it has been verified that the interaction of the electrical and acoustic stimulation results in an effect much stronger than the utilization of either of those stimulations in separate.

The distribution of heat and energy in the reservoir by the electricity and by the sonic waves may be calculated the same way as the heat effectively released by friction. The friction caused by sonic stimulation is created by the oscillation of the fluid droplets but, due to the electricity, it is generated by the molecular movement. The total energy input is thus limited by the cooling capacity of the oil produced. The calculation for this is simple:

$$Q = Mc(t_2 - t_1) \text{ (kJ/time unit)}$$

where:

M = mass of petroleum for each time unit (kg/h)

c = specific heat of petroleum (kJ/kg°C.)

$t_2$ = well temperature $t_1$ = average reservoir temperature

It should be noted that any of those vibrators can be used for well- or any other logging and/or stimulation known in the art, such as coalescing, vibro-drilling, deicing of soil, fracturing, etc.

We claim:

1. A process to increase the recovery of petroleum from a petroleum reservoir, comprising simultaneously subjecting a producing petroleum formation to electrical and vibratory stimulation, by supplying electrical current to the reservoir by means of an electrical cable installed in an annulus located between a production string and a casing utilizing part of the electrical current to operate a vibrator attached to the extremity of the production string, the electrical connection being obtained by means of connectors located at the vibrator which are hydraulically driven and attached to the uncovered extremity of the electrical cable, conducting the electrical current through said connectors to the casing which penetrates the petroleum formation at a point located above an isolation bridge, formed by cutting one part of the casing at a certain height above said formation to provide a cavity and filling the cavity with an isolating material.

2. A process to increase the recovery of petroleum from a petroleum reservoir, in accordance with claim 1, further comprising supplying the current alternatively to the reservoir by means of the production string which is centralized inside the casing by means of isolated centralizers.

3. A process to increase the recovery of petroleum from a petroleum reservoir, in accordance with claim 1, further comprising supplying the current alternatively to the reservoir by means of an isolated casing.

4. A process to increase the recovery of petroleum from a petroleum reservoir, in accordance with claim 1, further comprising alternatively supplying current to energize the vibrator, which is of a mechanical type which operates vertically, as alternating current, direct current impulses drained from the main power source, pulses supplied from capacitors, transformers or magnetic coils, all of them loaded as from the main power source.

5. A process to increase the recovery of petroleum from petroleum reservoirs, in accordance with claim 4, wherein the energy of the vertical displacement may be oriented approximately at 90°, and may be enlarged, hitting different expansion elements, such as a bar having V-shaped moving bodies (44A, 44B) attached thereto whereby upon pressing the bar, each second body moves against the other and presses the liquid between the bodies, generating pressure pulses capable of making the casing oscillate in several ways, in accordance with the acoustic characteristics of the reservoir.

6. A process to increase the recovery of petroleum from a petroleum reservoir, in accordance with claim 4, further comprising orienting the vibrator to nearly 90° and enlarging its action by pressing a piston into a liquid contained in expansion tubes of different formats, so that the various sound waves may make the casing oscillate in different ways, in accordance with the acoustic characteristics of the reservoir.

7. A process to increase the recovery of petroleum from a petroleum reservoir, in accordance with claim 4, further comprising utilizing the energy of the vertical displacement of the vibrator to energize expansion devices, which may alter and/or enlarge the course of the original vertical displacement.

8. A process to increase the recovery of petroleum from a petroleum reservoir, in accordance with claim 1, further comprising energizing the vibrator, which is of an electro-mechanical type which actuates horizontally, by current impulses originating from the alternating current up to the reservoir itself, impulses of direct current drained directly from the main power source, or pulses supplied by capacitors, transformers or magnetic coils, all of them loaded as from the main power source.

9. A process to increase the recovery of petroleum from a petroleum reservoir, in accordance with claim 8, further comprising generating the pulse of the vibrator through momentum resulting from the superimposition of electrical and magnetic fields and generating the magnetic field wound around a rolled core, wherein expansion elements which conduct the current are selected among a corrugated tube in stainless steel, a hose made of silicone, both filled with a conducting liquid, a steel tube divided into current conducting elements attached thereto and joining means for the expansion element are comprised of a silicone hose or a corrugated steel tube.

10. A process to increase the recovery of petroleum from a petroleum reservoir, in accordance with claim 8, further comprising activating the pulse of the vibrator by the attraction of a special expansion tube towards the steel casing, because of a magnetic field generated from a coil wound around a rolled core, so that the casing of the expansion tube acts as if it were the wave transmitting element.

11. A process to increase the recovery of petroleum from a petroleum reservoir, in accordance with claim 8, further comprising providing the pulse of the vibrator by hammering pairs of bars, located in the center of magnetic coils, against bodies radially oriented by magnetic forces, so that the radial bodies enlarge the force in the hitting and orient it at 90°, hitting an expansion tube located externally to the coils, so that the expansion tube actuates as if it were the wave transmitting element itself.

12. An apparatus to increase the recovery of petroleum from a petroleum reservoir, comprising mechanical vibrator means energizable by current impulses supplied to the reservoir from a main power source; said vibrator means being disposed in a casing and upon energization being displacable in directions disposed at approximately 90° relative to each other and expansion means in said casing engagable by said vibrator means to oscillate said casing in accordance with the acoustic characteristic of the reservoir.

13. An apparatus to increase the recovery of petroleum from a petroleum reservoir in accordance with claim 12, wherein the vibrators can oscillate vertically and horizontally.

* * * * *